US008328252B2

(12) United States Patent
Tonelli

(10) Patent No.: US 8,328,252 B2
(45) Date of Patent: Dec. 11, 2012

(54) GRIP ASSEMBLY, PARTICULARLY FOR SUITCASES AND TRUNKS

(75) Inventor: Massimo Tonelli, Casalecchio di Reno (IT)

(73) Assignee: G.T. Line S.R.L., Crespellano (IT)

( * ) Notice: Subject to any disclaimer, the term of this patent is extended or adjusted under 35 U.S.C. 154(b) by 276 days.

(21) Appl. No.: 12/662,093

(22) Filed: Mar. 31, 2010

(65) Prior Publication Data

US 2011/0240427 A1 Oct. 6, 2011

(51) Int. Cl.
*B25J 15/00* (2006.01)

(52) U.S. Cl. ..... 294/2; 294/119.1; 294/86.4

(58) Field of Classification Search ..... 294/2, 67.33, 294/81.54, 86.4, 185, 119.1, 902; 414/736, 414/737, 741
See application file for complete search history.

(56) References Cited

U.S. PATENT DOCUMENTS 4,453,873 A * 6/1984 Curti ..... 414/796.9
4,494,298 A 1/1985 Matsuura et al.
4,627,785 A * 12/1986 Monforte ..... 414/730
4,815,781 A * 3/1989 No et al. ..... 294/198
4,828,304 A * 5/1989 No et al. ..... 294/2
4,911,098 A * 3/1990 Tabata ..... 118/423
5,024,575 A * 6/1991 Anderson ..... 414/627
7,044,706 B2 * 5/2006 Jung ..... 414/737
7,562,923 B2 * 7/2009 Han et al. ..... 294/119.1
2005/0008469 A1 1/2005 Jung

FOREIGN PATENT DOCUMENTS

GB 2 378 172 A 2/2003

* cited by examiner

*Primary Examiner* — Dean Kramer
(74) *Attorney, Agent, or Firm* — Modiano & Associati; Albert Josif; Daniel J. O'Byrne

(57) ABSTRACT

A grip assembly, particularly for suitcases and trunks, constituted substantially by two mutually articulated half-shells which are adapted to form an internal containment compartment. The grip assembly comprises at least one grip hand which can be actuated on command, according to predefined paths, for the removable gripping and transport of selectively one among a plurality of containment trays for the half-shells. The gripping occurs at a perimetric portion having a predefined shape that is common to all of the trays. Each tray comprises at least one seat having variable dimensions at its central portion for accommodating half-shells of various formats.

8 Claims, 7 Drawing Sheets

GRIP ASSEMBLY, PARTICULARLY FOR SUITCASES AND TRUNKS

The present invention refers to a grip assembly, particularly for suitcases, trunks and the like.

BACKGROUND OF THE INVENTION

Nowadays, a company that wants to offer a product such as a suitcase, a trunk, or other type of transportable container, and that wants to keep up with the competition in a market which is increasingly competitive, must be capable of providing a high degree of customization for objects that, in and of themselves, already have shapes and sizes that may be very different.

The plurality of formats to be handled that derives from this fact often makes it preferable to use processes of production and assembly in which some or all of the phases of such production process, as well as the phases of handling and movement of the products, are performed by a skilled operator.

Considering professional briefcases, for example, these are typically comprised of two half-shells, made of plastics and mutually articulated.

The associated production process is assigned to an operator who manually assembles the two half-shells and fits any additional elements.

Owing to the variability of the formats to be handled, the transfer and movement of the products, as well as the transfer and movement of the half-shells, are delegated to the operator, since it is not possible to define an automated process due to such a plurality of formats to be handled.

Such a solution is not, however, without drawbacks.

It appears evident that the necessity of employing a human operator involves a significant rise in production costs.

In addition, employing a human operator means that it is impossible to significantly reduce the time needed to execute the production phases performed by such operator, except by employing an excessively high (and economically unacceptable) number of operators.

SUMMARY OF THE INVENTION

The aim of the present invention is to solve the aforementioned drawbacks, by devising a grip assembly that allows the automation of the phases of movement and manipulation of a plurality of products such as briefcases, suitcases and the like, even products having different formats, thus freeing the associated phases of the production process from the need to employ a human operator.

Within this aim, an object of the invention is to devise a grip assembly that allows the reduction of the time needed for the production and/or assembly of products such as briefcases, suitcases and the like.

Another object of the invention is, to devise a grip assembly that implements the gripping of the products while maintaining an exact reference of their position and orientation.

A further object of the invention is to devise a grip assembly that ensures a high level of reliability in operation.

A further object of the invention is to devise a grip assembly that can be easily made from elements and materials that are easily available on the market.

A further object of the invention is to devise a grip assembly that can be made at low cost and applied safely.

This aim and these and other objects which will become better apparent hereinafter are achieved by a grip assembly, particularly for suitcases, trunks and the like, constituted substantially by two mutually articulated half-shells which form an internal containment compartment, characterized in that it comprises at least one grip hand, which can be actuated on command, according to predefined paths, for the removable gripping and transport of selectively one among a plurality of containment trays for the half-shells, said gripping being effected at a perimetric portion having a predefined shape that is common to all of said trays, each of said trays comprising at least one seat having variable dimensions at its central portion for accommodating half-shells of various formats.

BRIEF DESCRIPTION OF THE DRAWINGS

Further characteristics and advantages of the invention will become better apparent from the following detailed description of a preferred, but not exclusive, embodiment of the grip assembly according to the invention, illustrated by way of non-limiting example in the accompanying drawings, wherein.

DESCRIPTION OF THE PREFERRED EMBODIMENTS

Figure 1:
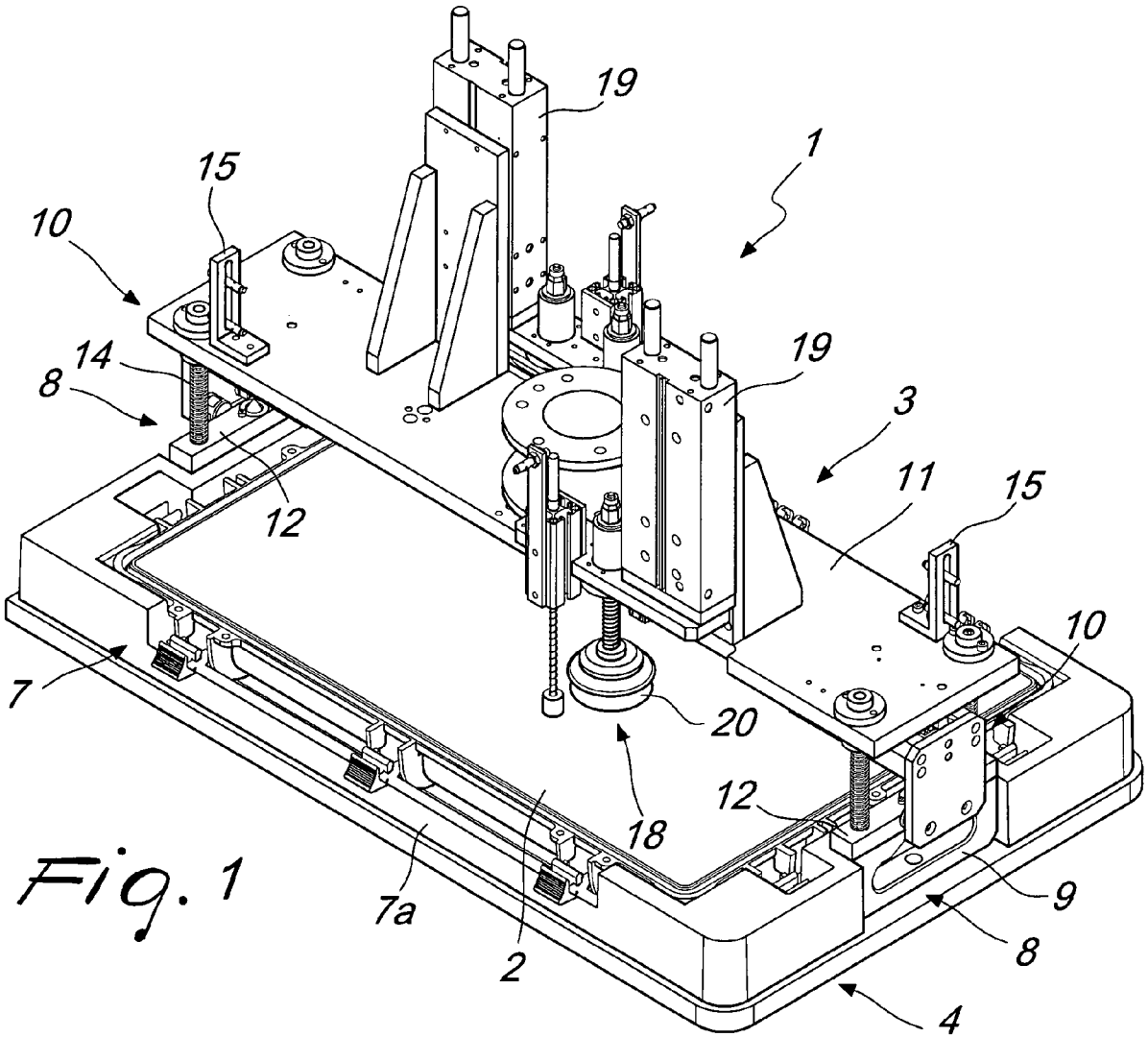
FIG. 1 is a perspective view of a grip assembly according to the invention.
Figure 2:
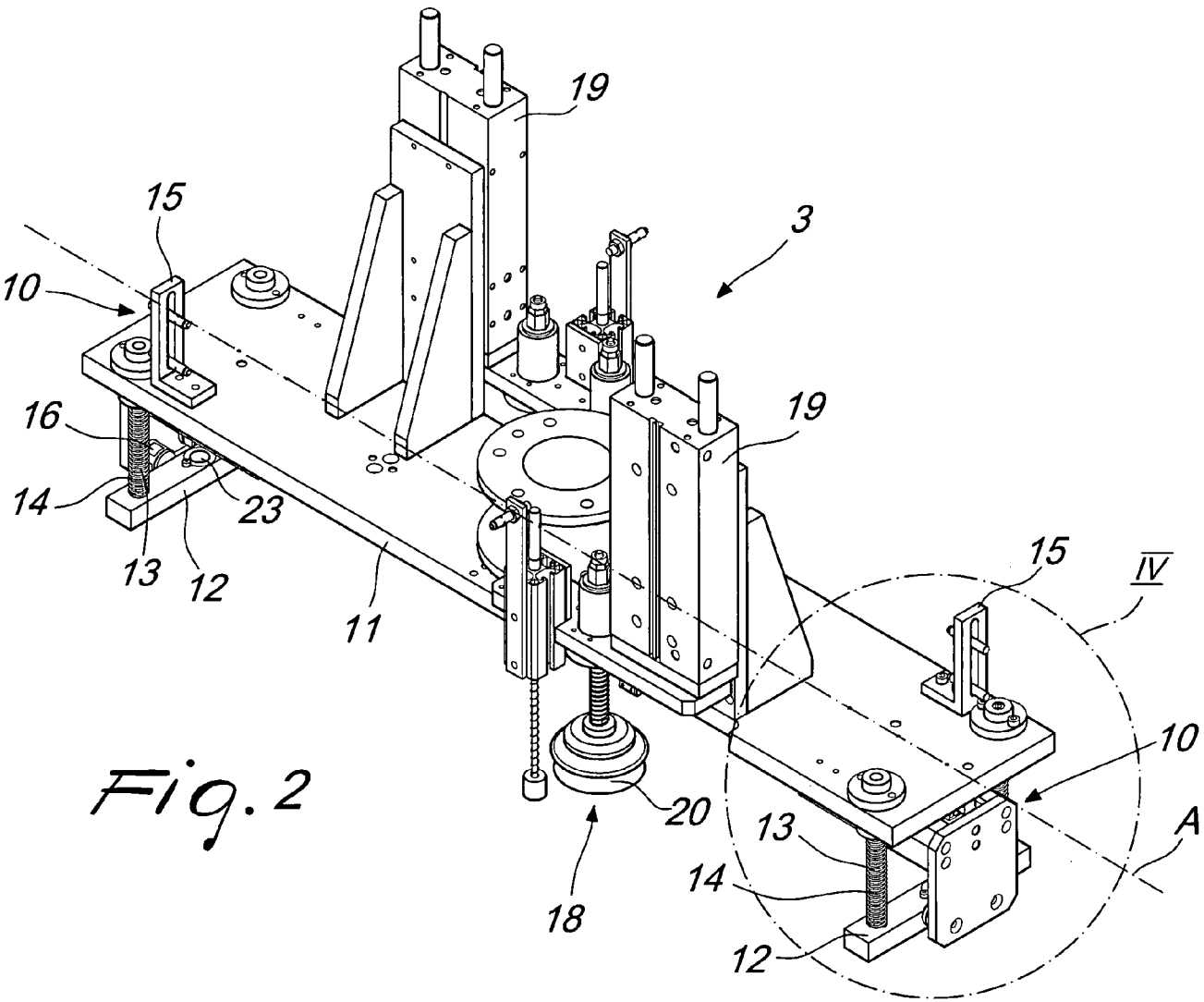
FIG. 2 is a perspective view of the grip hand.
Figure 3:
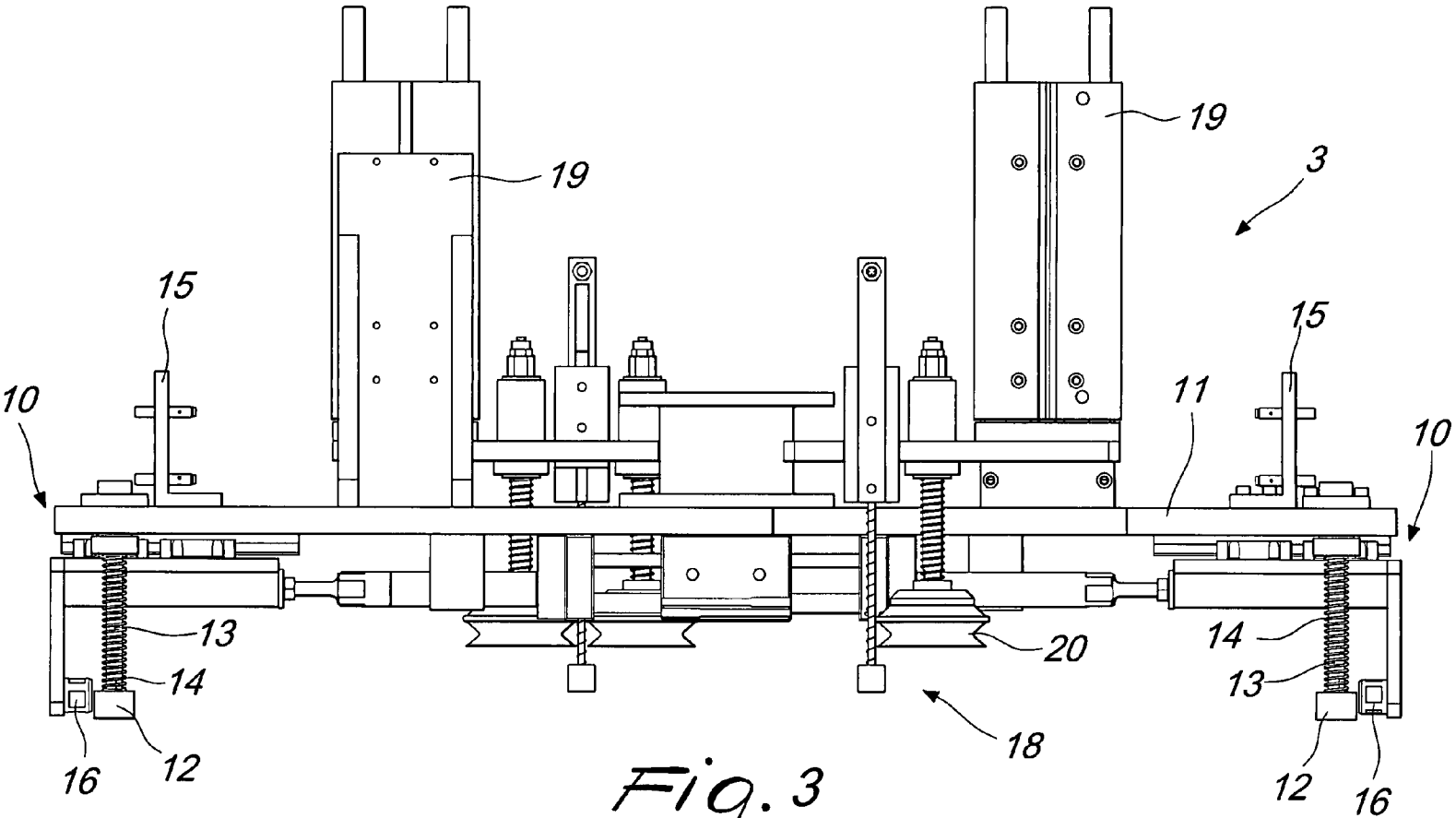
FIG. 3 is a front elevation view of the grip hand.

With reference to the figures, a grip assembly, according to the invention, designated generally by the reference numeral 1, is particularly suitable for the transport and movement of products of the type of suitcases, trunks and the like.

It should be clear right from the beginning that uses of the grip assembly 1 according to the invention which are intended for handling various different types of product are not excluded, if the shape and specific requirements should make such types of products possible and advantageous.

The suitcases, or similar products, that therefore constitute the preferred but not exclusive application of the grip assembly 1 according to the invention are substantially constituted by two mutually articulated half-shells 2, which form an internal containment compartment, for utensils, tools and other objects of any type.

According to the invention, the grip assembly 1 comprises at least one grip hand 3 which can be actuated on command according to predefined paths. The grip hand 3 could for example be constituted by the terminal organ of a serial manipulator and therefore have six degrees of freedom, necessary to move freely within a predefined workspace.

In this way, a control and management unit can command the grip hand 3 and move it according to predefined paths, which can be reprogrammed if necessary, for picking up and putting down the half-shells 2 from one workstation to another.

The half-shells 2 can thus be picked up, without requiring an operator, from a storage area and put down at a workstation, where such half-shells can be subjected to various different kinds of processing.

For example, at the workstation it will be possible to lay a gasket seal in a shaped groove, or perform the assembly of various additional components, such as screws, handles, shoulder straps etcetera.

Subsequently, the half-shell 2, gripped by the grip hand 3, can be picked up from the workstation and taken to the next station or to a storage area for semi-processed products (again, without requiring an operator).

To achieve such a result, the grip hand 3 can removably grip and transport a containment tray 4 of the half-shells 2, the tray 4 being selected from a plurality of trays, different from each other but presenting, as better illustrated hereinafter, a number of elements that are common to all such trays.

The gripping is effected at a perimetric portion of the tray 4 having a predefined shape that is common to all of the trays 4. In this way it is possible to handle the various different formats of the products by means of the same automated system and in particular by means of the same manipulator, fitted with the grip hand 3 which interfaces with an element, described hereinafter, that is standardised and present on all the trays 4.

To allow the reception and transport of the half-shells 2, each tray 4 comprises, at its central portion, at least one seat 5, having dimensions that can vary from one tray 4 to the next, for accommodating the half-shells 2 of various formats.

In this way it is possible to move and manipulate different formats of products of the type described hereinbefore, but without employing a human operator.

The grip assembly 1 is thus suitable for transporting single half-shells 2, or a suitcase, a trunk or the like, if the first half-shell 2, accommodated in the seat 5, is coupled to the second half-shell 2.

Figure 6:
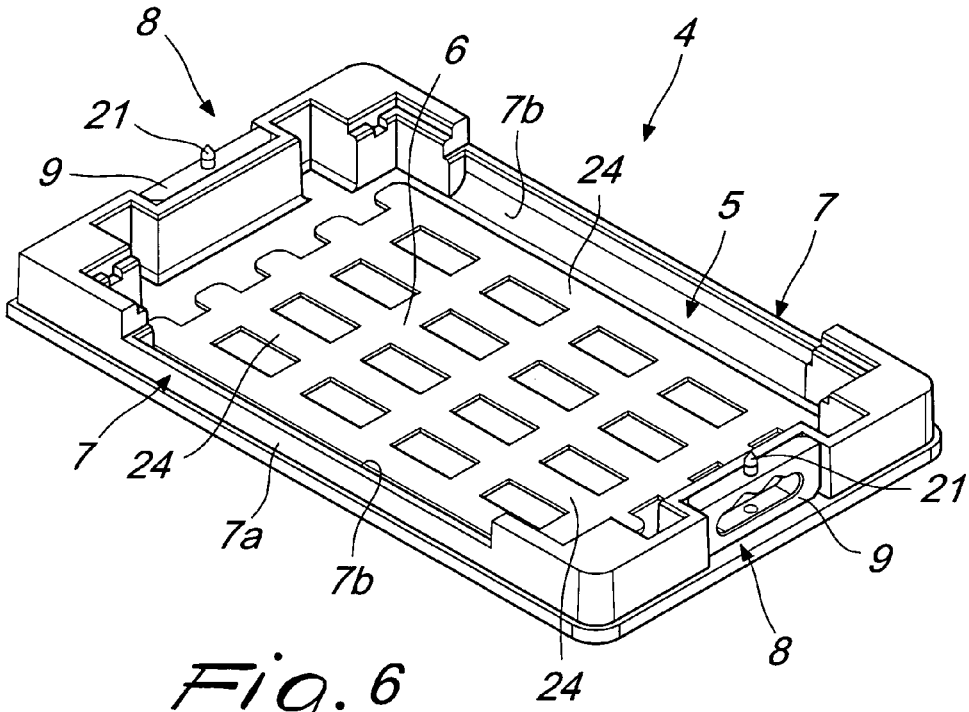
FIG. 6 is a perspective view of the containment tray.
Figure 7:
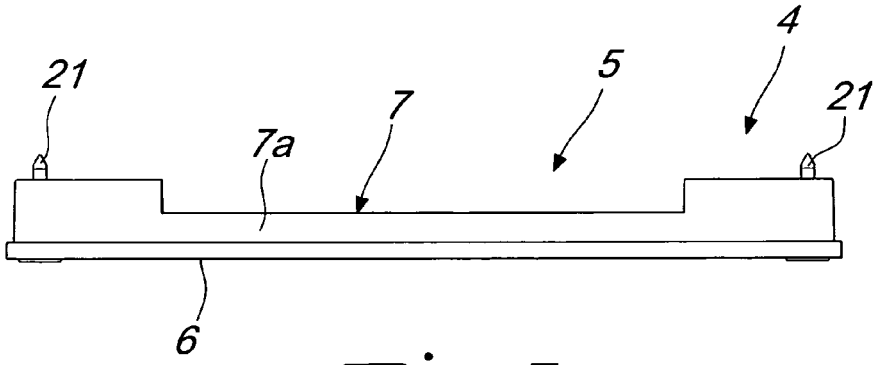
FIG. 7 is a front elevation view of the containment tray.
Figure 8:
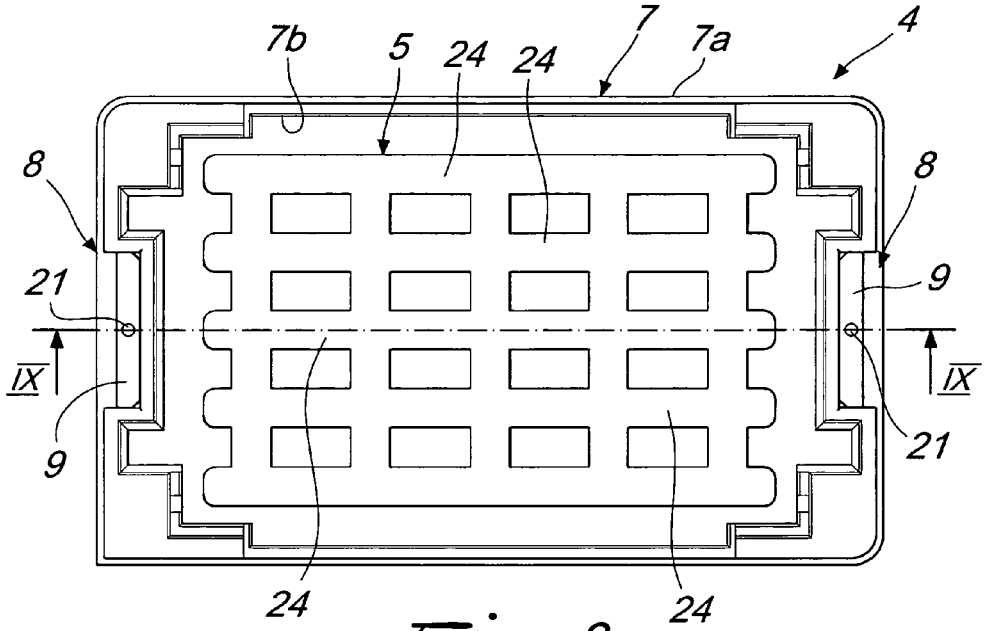
FIG. 8 is a plan view of the containment tray.
Figure 9:
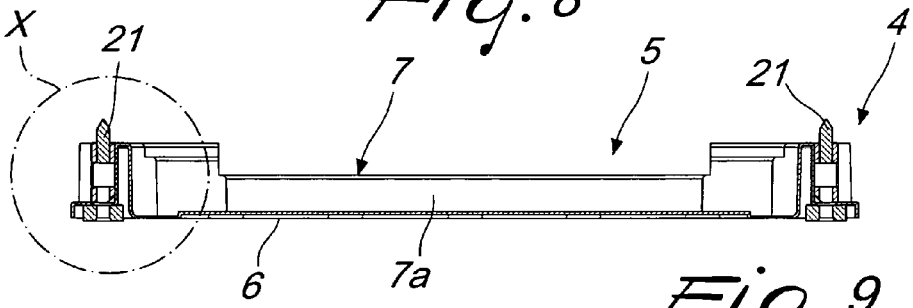
FIG. 9 is a sectional view taken along the line IX-IX of FIG. 8.
Figure 10:
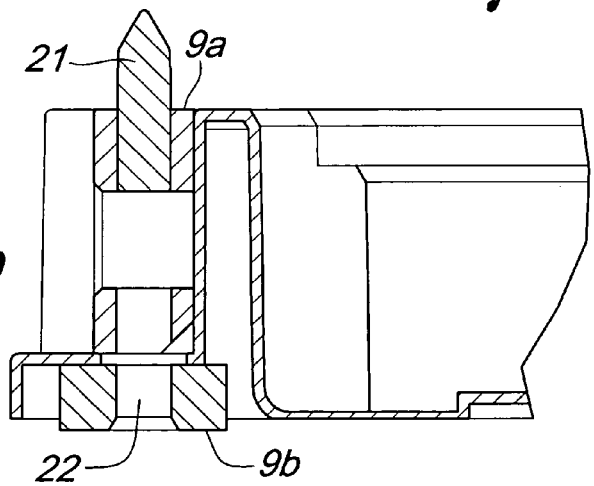
FIG. 10 is a strongly enlarged view of the detail X of FIG. 9.
Figure 11:
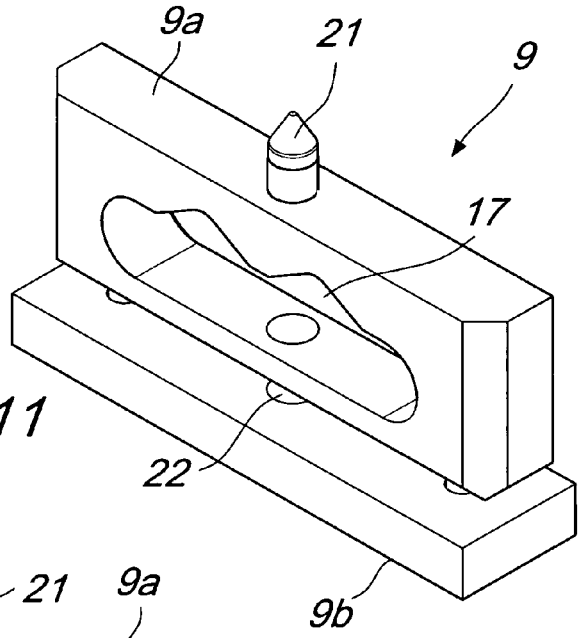
FIG. 11 is a perspective view of component of the grip hand.
Figure 12:
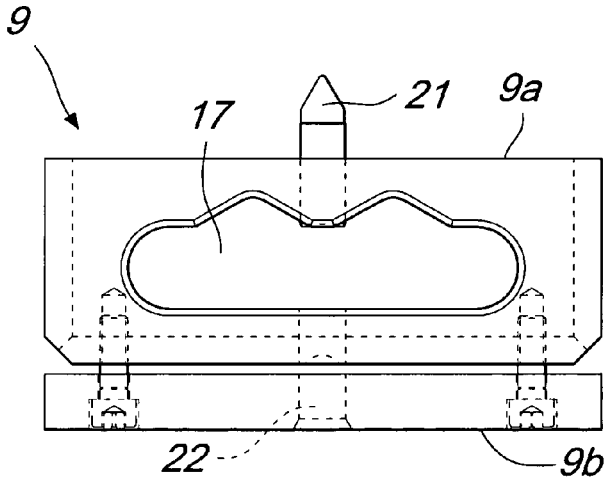
FIG. 12 is a front elevation view of the same component of FIG. 11.
Figure 13:
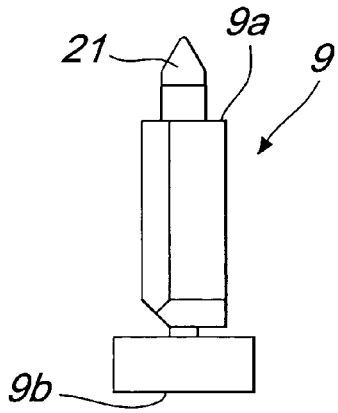
FIG. 13 is a side elevation view of the same component of FIG. 11.
Figure 14:
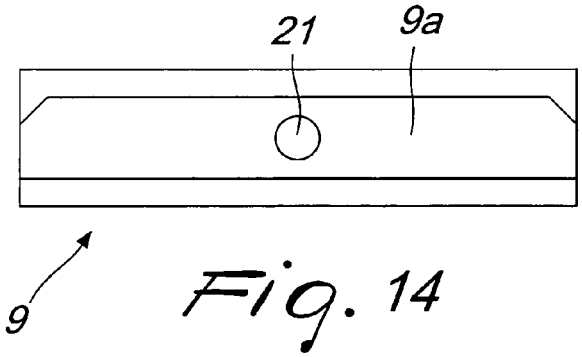
FIG. 14 is a plan view of the same component of FIG. 11.

According to a non-limiting embodiment of particular practical interest of the application of the invention, and with particular reference to FIGS. 6, 7 and 8, each tray 4 comprises a bottom surface 6 which has a substantially rectangular plan shape, from which a raised edge 7 rises, arranged at least along the perimeter of the tray 4.

The outside walls 7*a* of the edge 7 have a predefined shape which is common to all the trays 4, and along such walls there are two recesses 8 to which two respective handles 9 are fixed, shown in particular in FIGS. 11 to 14 and which also have a predefined shape which is common to all the trays 4.

As shown in FIGS. 6 and 8, the handles 9 are on opposite sides of the tray 4 (on the two short sides).

Figure 4:
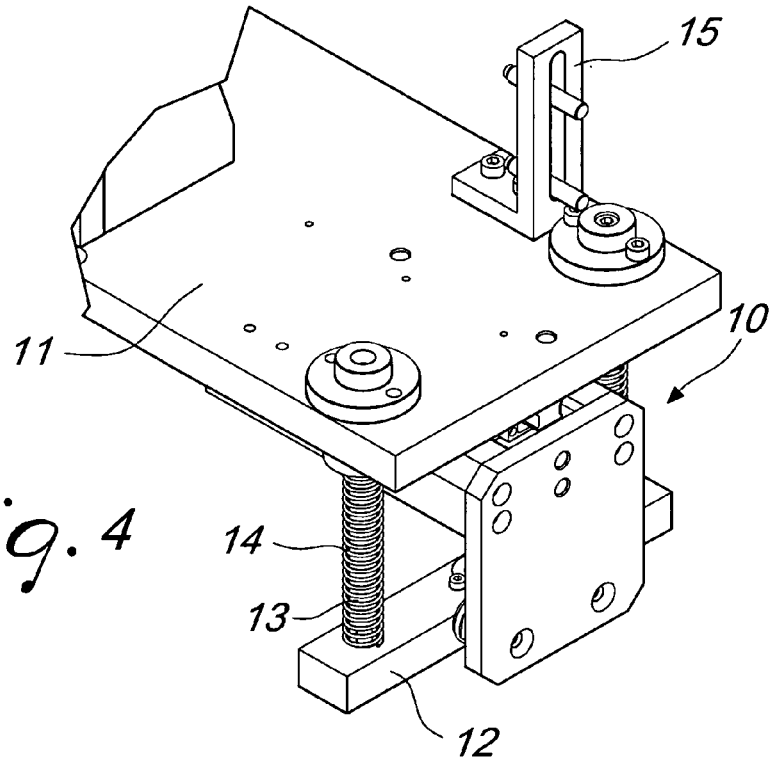
FIG. 4 is a strongly enlarged view of the detail IV of FIG. 2.

The grip hand 3 comprises tips 10, one of which is shown in detail in FIG. 4, in one possible embodiment; each tip 10 can be removably coupled with a corresponding handle 9 of the tray 4 for gripping it.

According to the embodiment shown herein, only for the purposes of illustration, and with reference to FIGS. 2, 3, 4 and 5, the grip hand 3 comprises a plate 11 that is elongated along a main axis A; the tips 10 are arranged at the end portions of the plate 11, with respect to the main axis A.

In particular, the tips 10 protrude perpendicularly to the plate 11 and are capable of movement in a direction that is parallel to the main axis A and in a direction that is perpendicular to the plate 11.

Such movements of the tips 10 permit the grip hand 3 according to the invention to be brought from a free configuration to a gripping configuration (shown for example in FIG. 1) of the tray 4, and vice versa.

More specifically, each tip 10 comprises a strip 12 which can move along a direction that is perpendicular to the plate 11; the strip 12 is fixed to at least one shaft 13 which is perpendicular to the plate 11 and which can axially slide in a guide defined in the end portion of the plate 11.

A spring 14 surrounds each shaft 13 and elastically contrasts the motion of the strip 12 and of the shaft 13.

To move from the free configuration to the gripping configuration, the control and management unit commands the grip hand 3 to move until it is positioned over the tray 4. Subsequently, the grip hand 3 is lowered towards the tray 4 until the strip 12 is brought into contact with the top 9*a* of the handle 9 and subsequently, continuing its motion, the grip hand 3 contrasts the action of the spring 14 and causes the rising of the shaft 13 which pushes upwards against the plate 11, while the strip 12 approaches the grip hand 3.

Such rising continues until an intermediate configuration is obtained which corresponds to the detection, for example by a proximity sensor 15, that the desired stroke limit has been reached: once such intermediate configuration has been achieved, the control and management unit commands a protrusion 16 which is operatively associated with the tip 10 to perform a translational motion in the direction that is parallel to the main axis A.

The translational motion causes the protrusion 16 to engage in a cavity 17 formed in the handle 9, thus achieving the gripping configuration and enabling the picking up and movement of the tray 4.

Once the tray 4 has been set down at the destination station, the control and management unit commands the tips 10 to disengage by performing a translational movement in the direction opposite to the protrusions 16. Subsequently it is sufficient to lift the grip hand 3 to allow the elastic return of the spring 14 which thus returns the strip 12 to its initial position (of interference with the translational movement of the protrusion 16) and the grip hand 3 to the free configuration.

Figure 5:
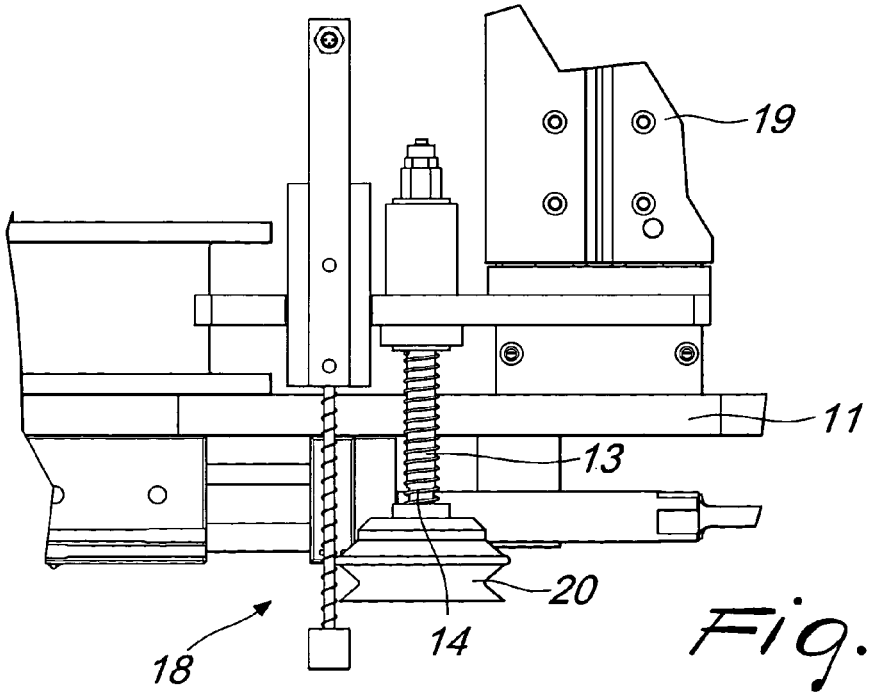
FIG. 5 is a strongly enlarged front elevation view of another detail of FIG. 2.

Usefully, the grip hand 3 comprises means 18 for anchoring to the half-shell 2, shown in the detail view of FIG. 5, which allow the half-shell 2 to be transported directly, by picking it up from the tray 4.

Specifically, the anchoring means 18 comprise at least one actuator 19 for actuating at least one sucker 20 which can be rigidly fixed to the half-shell 2 by partial vacuum.

Advantageously, a pin 21 protrudes upwards from the top 9*a* of each handle 9, the pin 21 being able to engage removably in a corresponding hole 22 formed along the base 9*b* of each handle 9. The grip hand 3 can thus set down a tray 4 above another tray 4 thus achieving a practical stacking of at least two trays.

By dimensioning the pin 21 and the hole 22 appropriately in such a way as to limit the plays, such stacking becomes stable and precise, enabling the subsequent movement of a pallet carrying a stack of trays 4 without the risk that they fall, or the risk of excessive oscillations of the trays 4 and of the half-shells 2 they are accommodating.

The grip assembly 1 according to the invention therefore allows a convenient stacking of the half-shells 2, for their possible subsequent storage in an appropriate area by means of a pallet.

In the gripping configuration, the pin 21 engages in a slot 23, similar to the hole 22, formed in the strip 12; such coupling ensures the precise positioning of the tray 4 with respect to the grip hand 3, thus contributing to the exact definition of the position of the half-shell 2 with respect to the grip hand 3.

According to a possible embodiment, the bottom surface 6 and the internal walls 7*b* of the perimetric edge 7 form the aforementioned seat 5, in which at least one half-shell 2 is correctly positioned and accommodated.

By varying the dimensions and shape of the internal walls 7*b*, it is thus possible to devise trays 4 that are suitable for transporting different formats of half-shells 2.

In particular, according to the embodiment shown in the accompanying figures, the half-shell 2 engages the rectangular edge 7 substantially at the four corners, while along the rest of the internal walls 7*b* there are grooves which for example allow the subsequent fitting of handles.

The decision to use only the corners of the edge 7 for positioning is due to the fact that the dimensional stability of the half-shells 2 is particularly high right at the edges, and the positioning of the half-shells 2 in the seats 5 and therefore in the trays 4 is of optimal precision.

Usefully, at one of the four aforementioned corners, at least two internal walls 7*b* form a reference edge; such reference edge (obtained for example by not connecting them, unlike the other three) makes it possible to have a definite reference of the orientation of the tray 4 and of the half-shell 2 contained in it.

It can immediately be seen how the positioning, of the half-shell 2 inside the seat 5 and hence of the tray 4 is therefore uniquely determined: it follows from this that also the position of the half-shell 2 with respect to the grip hand 3 is always uniquely determined.

In this way it is always possible to definitely and exactly know the position of the half-shell 2, making it possible to program the other workstations to make them interact easily and independently with the half-shell 2, without the intervention of human operators, even for the execution of precision operations, such as the aforementioned fitting of gasket seals or other components (or the fitting of the second half-shell 2 to the first).

Conveniently, it is possible to fit the tray 4, or at least some of them, with an internal ridge, which extends perpendicularly to the bottom surface 6 to subdivide the space delimited by the bottom surface 6 and by the internal walls 7*b*, thus forming at least two seats 5.

It is thus possible to simultaneously accommodate and move, using the same tray 4, two or more half-shells 2, for example belonging to reduced-format suitcases or trunks.

As can be seen for example from FIGS. 6 and 8, the bottom surface 6 has reinforcement ribs 24 which increase the mechanical rigidity of the tray 4, guarding against the risk of its breaking as a result of the stresses imposed by the handling and by the loads (the half-shells 2) carried.

In practice it has been found that the grip assembly according to the invention fully achieves the intended aim and objects, in that the use of a grip hand that can transport selectively one among a plurality of containment trays, accommodated in a seat formed in a central portion of such trays, owing to the gripping that is effected at a perimetric portion with a predefined shape which is common to all the trays, allows the automation of the phases of movement and handling, freeing the associated phases of the production process from the need to employ a human operator.

The invention, thus conceived, is susceptible of numerous modifications and variations, all of which are within the scope of the appended claims; in addition, all the details may be replaced by other technically equivalent elements.

In the exemplary embodiments illustrated, individual characteristics given in relation to specific examples may actually be interchanged with other different characteristics existing in other exemplary embodiments.

In addition, it should be noted that anything found to be already known during the patenting process is understood not to be claimed and to be the subject of a disclaimer.

In practice the materials employed, as well as the dimensions, may be any according to requirements and to the state of the art.

What is claimed is:

1. A grip assembly, for gripping elements constituted substantially by two mutually articulated half-shells which form an internal containment compartment, the grip assembly comprising at least one grip hand, which can be actuated on command, according to predefined paths, for the removable gripping and transport of selectively one among a plurality of containment trays for the half-shells, said gripping occurring at a perimetric portion having a predefined shape that is common to all of said trays, each of said trays comprising at least one seat having variable dimensions at its central portion for accommodating half-shells of various formats, each of said trays further comprising two recesses for fixing two respective handles, said grip hand comprising tips that can be coupled detachably to said respective handles for gripping each tray, said grip hand comprising a plate that is elongated along a main axis, said tips being arranged at end portions of said plate with respect to said main axis, said tips protruding at right angles from said plate and being movable along a direction that is parallel to said main axis and along a direction that is perpendicular to said plate for the passage of said grip hand from a free configuration to a gripping configuration of said tray, and vice versa, each of said tips comprising a strip, which can move along said direction that is perpendicular to said plate, said strip abutting elastically against a top of a respective handle of said two handles for passing from said free configuration to an intermediate configuration, in order to allow translational motion along the direction that is parallel to said main axis of a protrusion, which is functionally associated with said tip, in order to engage in a cavity that is formed in said respective handle and provide the transition from said intermediate configuration to said gripping configuration.

2. The grip assembly according to claim 1, wherein each of said trays comprises a bottom surface that has a substantially rectangular plan shape, a raised edge protruding at least perimetrically from said bottom surface, and outer walls of said edge having a predefined shape that is common to all of said trays and said two recesses being provided along said walls for fixing said two respective handles, which have a predefined shape that is common to all of said trays, said handles being arranged on opposite sides of said tray.

3. The grip assembly according to claim 2, wherein said bottom surface and the internal walls of said edge define said seat for the correct positioning and accommodation of at least one of the half-shells.

4. The grip assembly according to claim 3, wherein at least two of said adjacent internal walls form a reference edge of said tray and of the half-shell accommodated in said seat.

5. The grip assembly according to claim 2, wherein said bottom surface has reinforcement ribs to increase the mechanical rigidity of said tray.

6. The grip assembly according to claim 1, wherein said grip hand comprises means for anchoring to the half-shell, for its direct transport.

7. The grip assembly according to claim 6, wherein said anchoring means comprise at least one actuator for actuating at least one sucker, which can be rigidly fixed to the half-shell by partial vacuum.

8. The grip assembly according to claim 1, wherein a pin protrudes upward from said top of each of said handles and can engage in a respective hole that is formed along the base of each of said handles, in order to allow the stacking of at least two of said trays.

* * * * *